United States Patent [19]

Alguire

[11] Patent Number: 4,842,440

[45] Date of Patent: Jun. 27, 1989

[54] ROAD GRADER AND SCARIFIER

[75] Inventor: Robert Alguire, Brockville, Canada

[73] Assignee: Frink America, Inc., Clayton, N.Y.

[21] Appl. No.: 141,479

[22] Filed: Jan. 7, 1988

[51] Int. Cl.[4] ..... E01C 23/12

[52] U.S. Cl. ..... 404/90; 172/817; 298/17.6

[58] Field of Search ..... 404/83, 89, 90, 94, 404/86, 110; 299/24, 36; 37/219, 232, 268, DIG. 13; 172/816, 817; 15/93 R; 298/17.6

[56] References Cited

U.S. PATENT DOCUMENTS

| | | | |
|---|---|---|---|
| 1,642,747 | 9/1927 | Richardson | 404/110 |
| 2,059,818 | 11/1936 | Simon | 37/268 |
| 2,267,699 | 12/1941 | Kern, Jr. | 172/816 |
| 2,290,060 | 7/1942 | Massey | 299/24 X |
| 2,662,313 | 12/1933 | Mowe et al. | 172/817 |
| 2,825,985 | 3/1958 | Weeks | 172/816 X |
| 3,620,458 | 11/1971 | Rath | 239/657 |
| 4,056,283 | 11/1977 | Pow | 298/17.6 |
| 4,568,028 | 2/1986 | Verseef et al. | 298/17.6 X |

*Primary Examiner*—Jerome W. Massie, IV
*Assistant Examiner*—Matthew Smith
*Attorney, Agent, or Firm*—Wall and Roehrig

[57] ABSTRACT

A two-way spreader that is equipped to grade and scarify the surface of a road bed having a dump body that is tiltably mounted up the chassis of a motor vehicle so that the back of the dump body can be raised and lowered between a rest position against the chassis and an elevated position above the chassis. A frame is secured to the bottom of the dump body which is suspended behind the chassis. An elongated scraper blade is secured in the lower part of the frame and extends transversely to either side of the chassis. During grading operations, the weight of the dump body rests upon the blade as it is moved over the road bed.

9 Claims, 4 Drawing Sheets

ROAD GRADER AND SCARIFIER

BACKGROUND OF THE INVENTION

This invention relates to a two-way dump spreader and in particular to a two way spreader that is equipped with a combination road grader and scarifier.

In 1955 the present assignee introduced the now well known two way dump spreader wherein a vehicle equipped with a dump body could be used either as a spreader or a dump truck. Up until that time trucks used for spreading sand or salt over a road surface were equipped with a large hopper-like box capable of holding a quantity of sand or salt or a combination of the two. The material was fed to a spreader suspended from the back of the box which distributed the material behind the vehicle. The entire spreader unit typically was dedicated to perform only one task and at the end of the winter was generally placed in storage until the next winter. Accordingly, this expensive piece of equipment could only be used on a limited basis.

Typically, a combination dump spreader has a straight walled dump body mounted upon the chassis of the vehicle and dual hinge arrangement that permits either the front end or the back end of the body to be raised depending on the mode of operation that is selected. When the vehicle is to be used as a spreader or sander, a forward hinge is coupled to a hydraulic power cylinder and the dump body tilted in a forward direction to direct particulate material stored in the body into spreader chutes mounted on one or both sides of the vehicle forward of the rear wheels. When the vehicle is needed for use as a dump truck, the front hinge is uncoupled and a second rear hinge is coupled to the power cylinder. Actuating the cylinder causes the body to be tilted rearwardly whereby the load is dispensed through the tail gate.

The present invention further expands the utility of the two way spreader by providing a scraper blade attachment that is ideally well suited for grading and/or scarifying snow and ice covered road surfaces in the winter and unfinished or dirt road surfaces during warmer months. In many colder climates, road surfaces become completely covered with a hard packed layer of ice and snow that builds up to a point where it cannot be removed by a conventional snowplow. Attempting to spread sand or salt evenly over the hard packed road surface is extremely difficult because the particulate material, upon striking the hard packed surface, tends to bounce and roll to the shoulder of the road where it has little, if any, effect on road conditions.

It has been found that by moving a scraper blade equipped with teeth over an ice or snow packed road surface, valleys or indentations are formed along the surface of the road which capture and hold the dispensed sand and salt over the road bed where it can do the most good.

In many rural communities, unpaved or dirt roads are still in widespread use. These roads are in need of constant maintenance in order to keep the road bed in a condition to safely handle vehicular traffic. Here again, the vehicle best suited to perform this task is a single purpose road grader. Some poor rural communities, however, cannot afford this type of expensive specialized equipment. As a consequence, many of the roads fall into disrepair and can, in extreme cases, pose a hazard to vehicular travel.

As in the case of ice or snow covered roadways, it is desirable to spread particulate chemicals over dirt roads to prevent the spread of dust particularly during dry periods. Previously, oil was spread over these dirt roads to hold down the dust. However, the use of chemicals has replaced oil in treating dirt roads for environmental reasons. It is highly desirous to level the road beds while at the same time providing shallow grooves for capturing and holding dust suppressing chemicals. Again, this type of single purpose grading equipment is relatively expensive to purchase, maintain and operate, and in many cases, cannot be economically justified in many small rural communities.

SUMMARY OF THE INVENTION

It is therefore an object of the present invention to improve combination dump spreaders by providing this type of equipment with wider spread applications.

It is a further object of the present invention to provide a combination dump spreader that is equipped with a scraper blade attachment that can be brought into contact with a road bed to treat the road surface.

A still further object of the present invention is to provide a multi-purpose vehicle that can be used all year to carry out a number of different road related tasks.

These and other objects of the present invention are attained by means of a two way spreader that includes a dump body that is selectively coupled to the chassis of a motor vehicle by either a front hinge assembly or a back hinge assembly whereby the dump body can be tilted in a forward direction about the front hinge or a rearwardly direction about the back hinge. A heavy duty frame is secured to the back of the dump body which normally hangs below the body behind the chassis. A scraper blade is secured to the lower part of the frame. In operation, the dump body is rotated about the front hinge from an elevated position to a position wherein the scraper blade is resting upon the road surface under the weight of the dump body. As the vehicle moves forward, the blade is drawn over the road bed to either grade the road surface or scarify the road bed by adding grooves to the road surface that are capable of holding particulate road treating materials. The action of the blade may be regulated by adding or subtracting material from the load contained in the dump body.

BRIEF DESCRIPTION OF THE DRAWINGS

For a better understanding of these and other objects of the invention, reference is made to the following detailed description of the invention which is to be read in association with the accompanying drawings, wherein.

DESCRIPTION OF THE INVENTION

Figure 1:
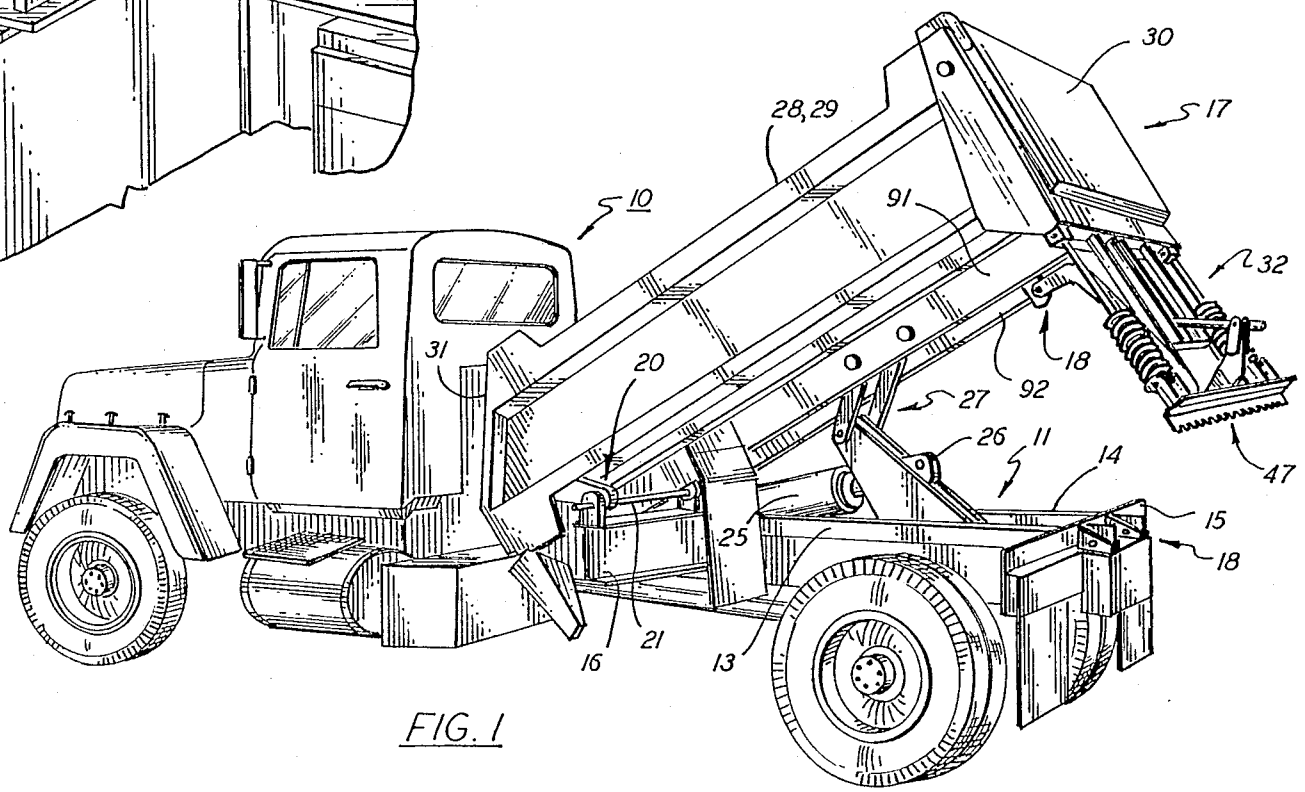
FIG. 1 is a perspective view of a motor vehicle having a dump body equipped with a combination road grading and scarifying assembly embodying the teachings of the present invention.

Referring initially to FIG. 1 there is shown a motor vehicle 10 that includes a chassis 11 having a pair of longitudinal members 13 and 14 and a pair of transverse members 15 and 16. As explained in greater detail in U.S. Pat. No. 3,620,458, a dump body 17 is hinged to the chassis at two separate locations. A removable hinge bar 21 can be selectively mounted in either a rear hinge assembly 18 or a front hinge assembly 20. In this particular embodiment the hinge bar 21 is shown inserted in the front assembly 20. The dump body can be tilted about the bar between a rest position, wherein the dump body is seated against the chassis of the vehicle, and an elevated position as illustrated in FIG. 1. A power cylinder 25 is mounted inside the chassis and includes an extendable arm 26 which is coupled to the dump body via linkage 27.

Typically, the dump body is raised by pumping oil into the power cylinder under pressure which forces the arm 26 to an extended position. The dump body is returned to a rest position by opening a control valve in the power cylinder return line. This, in turn, permits oil in the power cylinder to bleed back to the supply reservoir (not shown) under controlled conditions.

The dump body includes a pair of vertical side walls 28 and 29, a hinged tail gate 30 and a front wall 31.

Turning now to FIC 2, a combination grading and scarifying assembly generally referenced 32, is suspended from the dump body superstructure 34 along the rear edge thereof. The assembly is positioned far enough back on the body so that it will clear the truck chassis and other obstructions as the body is raised and lowered. The assembly includes a main supporting frame 33 having horizontal top rail 35 which is securely bolted to the bottom of the dump body superstructure, a pair of vertical beams 36 and 37, and a lower blade support member 38 that extends outwardly to either side of the main vertical beams. Gussett plates 39,39 are welded between the blade support members and the vertical beams 36 and 37 to provide added strength and stability to the assembly. Diagonal stabilizers 40 and 41 are also welded between the top rail and the two vertical beams of the frame for the same purpose. A pair of spaced hanger members 42 and 43 are suspended from the center of top rail 35 of the frame inside the two vertical beams. Braces 44 and 45 are welded between the hanger members and the vertical beams to support the lower part of the hangers in assembly. A blade adjusting mechanism 46, the function of which shall be explained in greater detail below, is mounted between the hangers and is operatively connected to the blade support member 35.

Figure 5:
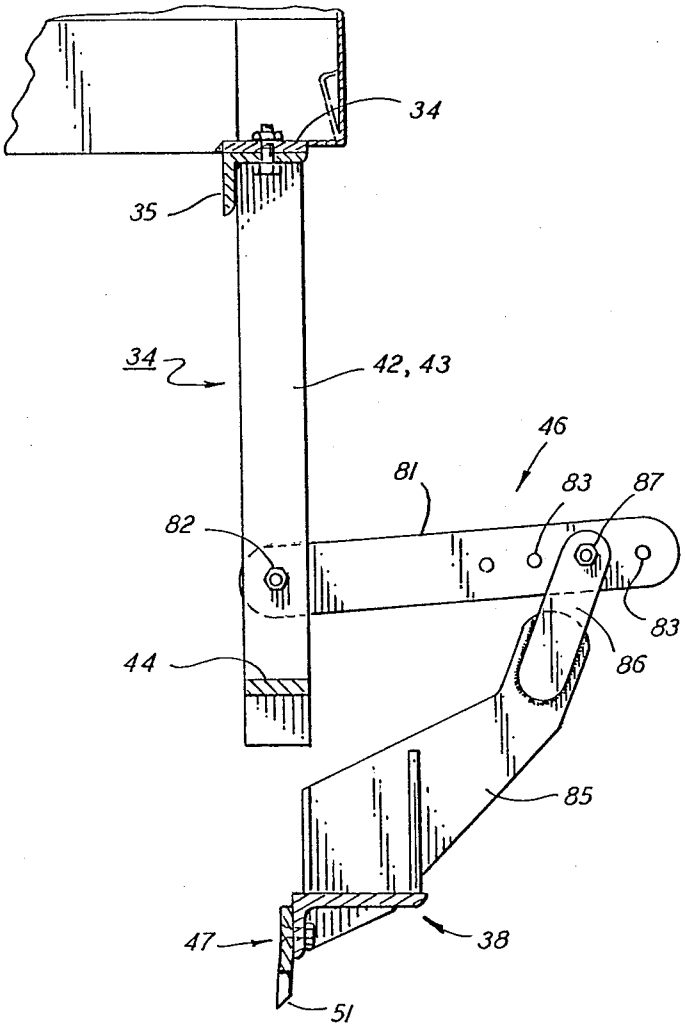
FIG. 5 is a sectional view taken along lines 5—5 in FIG. 2.

A vertically disposed serrated scraper blade 47 is bolted or otherwise secured to the extended lower support member of the frame. The blade contains a series of spaced apart grooves 48—48 that pass upwardly through the bottom edge 49 of the blade which divides the blade into a plurality of rectangular shaped teeth 50—50. The bottom surface of each tooth is beveled to form a chisel-like cutting edge 51 thereon (FIGS. 3–5).

Figure 2:
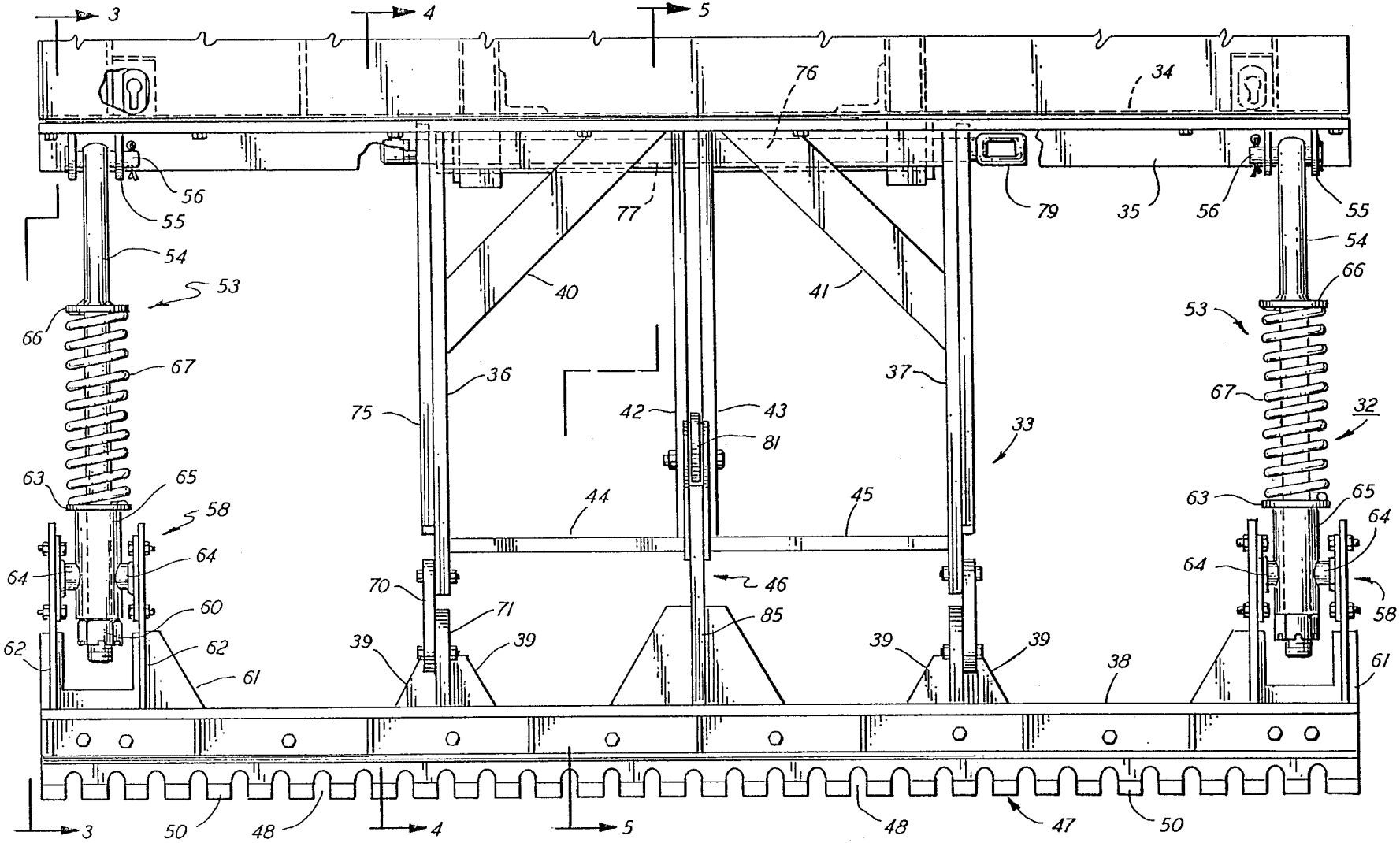
FIG. 2 is an enlarged elevation of the scraper blade assembly shown in FIG. 1.
Figure 3:
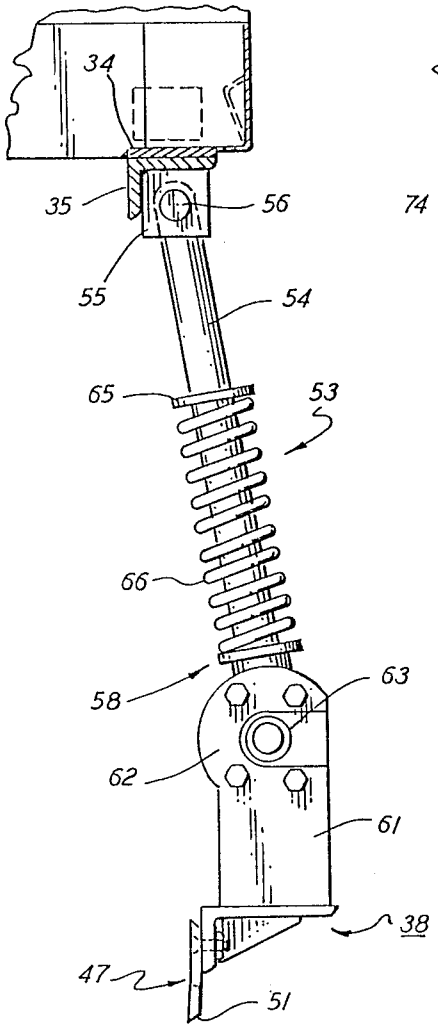
FIG. 3 is a sectional view taken along lines 3—3 in FIG. 2.

With further reference to FIGS. 2 and 3, the outboard ends of the blade support member are coupled to the top rear ends of the top rail 35 by two shock absorbing units 53—53 of similar construction. Each unit includes a cylindrical rod 54, which is hung in an upper bracket 55 upon a removable pin 56. The upper brackets are secured, as by welding, to the bottom of top rail 35 so that the bar hangs down over the end of the blade support member. The lower part of each rod is slidably housed within a slide unit generally referenced 58. Each slide unit contains a tubular member 65 that encircles the rod and is journalled for rotation in the upraised arms 62—62 of a lower mounting bracket 61. The lower brackets, in turn, are secured by any suitable means to blade support member 38.

A collar 66 is welded to the upper part of each rod 54. A compression spring 67 is wound about the rod beneath the collar and is biased between the collar and a washer 63 seated against the tubular member of the slide unit. A self locking nut 60 (FIG. 1) is threaded onto the free end of the rod which bears against the slide mechanism by loosening or tightening the nut, the biasing pressure of the spring can be adjusted. Each spring is mounted in a loaded condition in assembly so as to exert a downward force upon the two ends of the blade support member. The springs also absorb the impact produced by foreign objects striking the blade as it is being drawn over a road bed.

Figure 4:
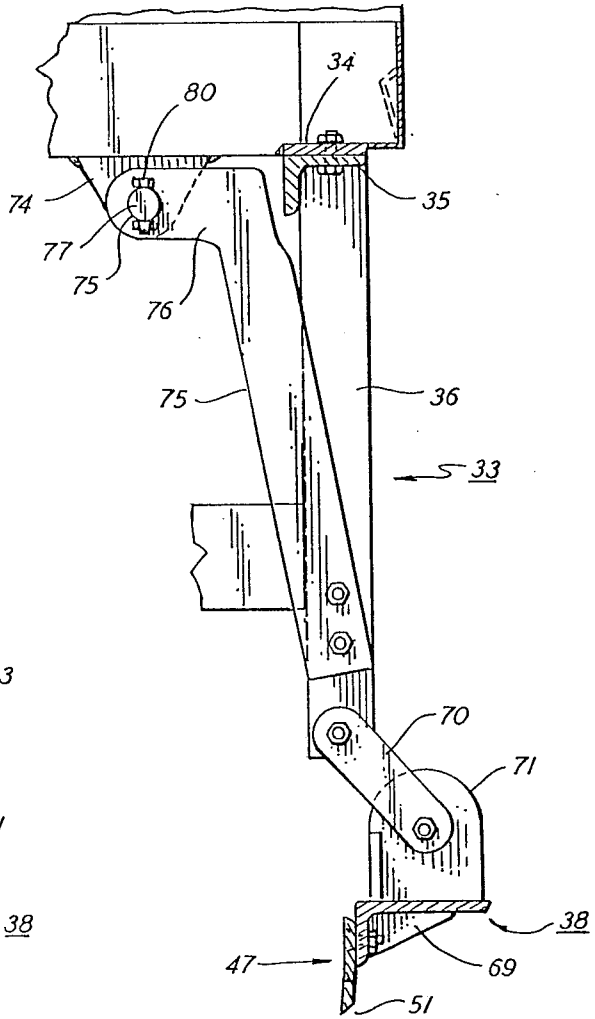
FIG. 4 is a sectional view taken along lines 4—4 in FIG. 2.

As illustrated in FIG. 4, the blade support member 38 is an angle iron 68 having reinforcing plates 69—69 welded at spaced intervals between the legs of the iron. The support rail is suspended from each of the vertical beams 36 and 37 of the frame upon a link 70. The link is bolted at one end to the bottom of the beam and at the other end to a raised connector 72 welded to the top of the support rail. The two links act in association with the two trunnion mounted slide mechanisms 53—53 to permit the support rail; and thus the scraper blade, to be turned so that the angle of attack of the blade with the road bed can be selectively adjusted.

A longitudinal brace 73 is rigidly bolted to the lower section of each vertical beam as shown in FIG. 4. The brace extends upwardly and terminates with a forwardly extended arm 74. The two arms are arranged to pass back over the end sections 75—75 of the rear hinge assembly 18. A hole 75 is passed through each arm which, in assembly is axially aligned with a hinge bar hole formed in the assembly. A locking bar 77 is passed through the aligned holes to removably support the brace in assembly. A gripping handle 79 is mounted on one lid of the bar and a bolt 80 passed through the opposite end to prevent the bar from being pulled out of the assembly.

Figure 7:
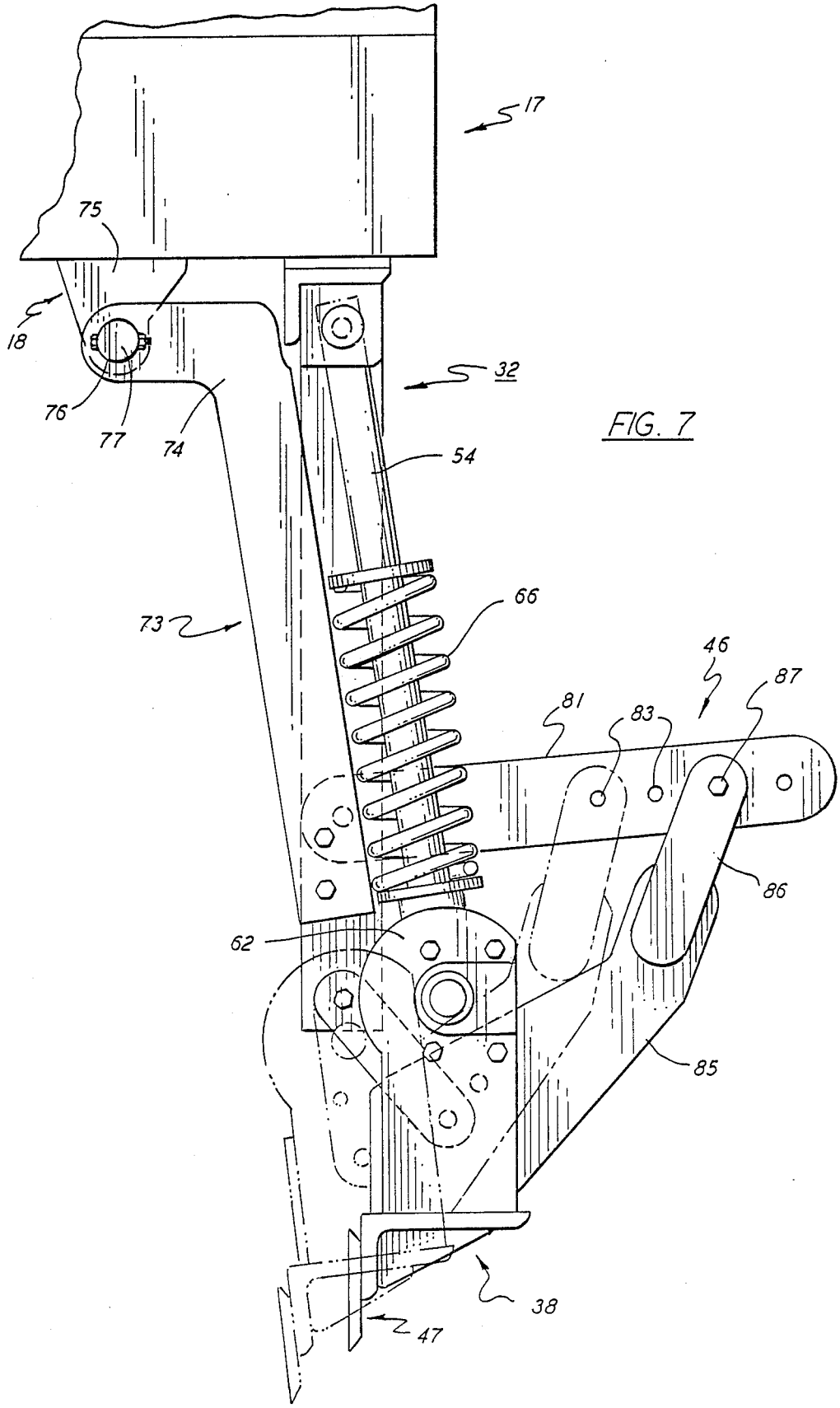
FIG. 7 is an enlarged end view of the scraper blade assembly.

As further illustrated in FIGS. 5 and 7, the blade adjusting mechanism 46 includes an adjusting plate 81 that is pivotably mounted between the previously noted hangers 42 and 43 (FIG. 2) by means of a pivot bolt 82. The adjusting plate has a series of locating holes 83—83 spaced along the axis of the plate. An adjusting arm 85 is welded to the top of the blade support member 38 and has an upwardly extended tab 86 containing a bolt hole that can be brought into axial alignment with one of the locating holes. A bolt and lock nut unit 87 is passed through the aligned holes to position the blade at a desired angle with the road surface. As illustrated in FIG. 7 in phantom outline, the angle of attack of the blade can be adjusted to meet changing road conditions by simply repositioning the bolt 87 in a selected one of the locating holes.

The frame is normally attached to the back of the dump body with the body being elevated as shown in FIG. 1 about the front hinge assembly 20. The desired angle of attack of the blade is then set using the adjusting mechanism for the intended grading operation. Upon bringing the vehicle over the road bed that is to be treated, the control valve in the power cylinder hydraulic circuit is opened and the dump body is allowed to move downwardly under its own weight until the blade rests upon the road surface. The blade is now held against the road by the weight of the dump body so that the bed is graded as the vehicle moves in a forward direction. Additional weight can be added to the dump body when required by simply loading sand or any other suitable material into the body.

Figure 6:
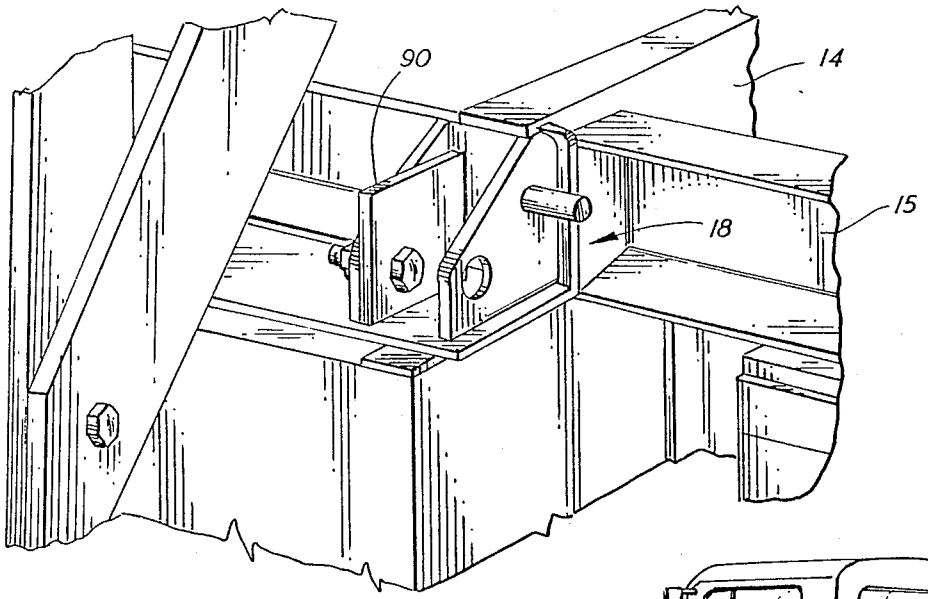
FIG. 6 is a partial perspective view showing the back of the motor vehicle chassis.

The extent of travel of the dump body in a downward direction is regulated by a pair of stop plates 90—90 (FIG. 1 and FIG. 6) that are bolted into the hinge seats of the rear hinge assembly. The height of the stop plate is regulated so that the longitudinal beams 91 and 92 will bottom against the stops in the event the scraper blade support structure over stresses and bends beyond its elastic limit.

While this invention has been explained with reference to the structure disclosed herein, it is not confined to the details set forth and this application is intended to cover any modifications and changes as may come within the scope of the following claims.

What is claimed is:

1. Apparatus for grading and scarifying the surface of a road bed that includes a dump body having a pivot means at the front thereof for supporting the dump body on a vehicle chassis, a power cylinder acting between the chassis and the dump body for tilting the dump body about the pivot to raise and lower the back of the dump body between a first rest position wherein the back of the dump body against the chassis and an elevated position wherein the back of the body is raised above the chassis, a vertically disposed frame centrally mounted upon the back of the dump body whereby the frame hangs behind the chassis when the dump body is in a rest position, a transversely disposed scraper blade suspended from the lower part of the frame in an adjusting means whereby the angle of attack of the blade in reference to the road bed can be regulated, and a downwardly disposed rod mounted at each rear corner of the dump body having a slide member mounted on the rod for reciprocal movement along the rod said slide member being attached to one end of the blade and a compressing spring wound about the rod that acts between the slide member and a stationary plate secured to rod for urging the blade downwardly away from the dump body whereby the spring absorbs the impact of road obstructions striking the blade.

2. The apparatus of claim 1 wherein the frame is rectangular shaped and further includes a pair of opposed end beams and a swing arm rotatably connecting the blade to each of the end beams and an adjusting arm mounted on the blade between the swing arms that is selectively positionable within an adjusting bracket suspended within the frame.

3. The apparatus of claim 2 that further includes a brace means for securing the lower section of each end beam and the dump body to prevent lateral movement of the frame.

4. The apparatus of claim 2 that further includes a stop block secured to the chassis of the vehicle that contacts the dump body to locate the position of the dump body when in the rest position.

5. Apparatus for scarifying a road surface as a motor vehicle moves thereover, said apparatus including a motor vehicle having a horizontally disposed chassis, a dump body mounted upon the chassis so that the back section of the dump body extends rearwardly beyond the chassis, pivot means for rotatably supporting the dump body on the chassis so that the back section of the dump body can be raised to an elevated position above said chassis, a rigid frame means secured to the back section of said dump body for supporting a horizontally disposed scarifying blade above a road surface when the back section of said dump body is in said elevated position and for lowering the scarifying blade into contact with the road surface when the rear section of the dump body is lowered from said elevated position to a second position above the chassis whereby the dump body rests on the blade, and drive means for raising and lowering the back section of dump body about said pivot means.

6. The apparatus of claim 5 wherein the scarifying blade extends laterally beyond either side of said frame means, and further includes shock absorbing means for connecting each extended end of the scarifying blade to the dump body.

7. The apparatus of claim 5 that further includes adjusting means acting between the frame means and the scarifying blade for changing the angle of the blade in regard to the road bed.

8. The apparatus of claim 5 that further includes a stop means for supporting the back section of the dump body in said second position.

9. The apparatus of claim 5 wherein said scarifying blade has laterally spaced grooves passing upwardly through the bottom edge thereof.

* * * * *